US006889858B2

(12) United States Patent
McCollum et al.

(10) Patent No.: US 6,889,858 B2
(45) Date of Patent: May 10, 2005

(54) MULTIPLE LABEL CONTAINER

(75) Inventors: Matthew S. McCollum, Jackson, MI (US); Patrick Taylor, Jackson, MI (US); Shawn R. LaRock, Manchester, MI (US)

(73) Assignee: Portola Packaging, Inc., San Jose, CA (US)

( * ) Notice: Subject to any disclaimer, the term of this patent is extended or adjusted under 35 U.S.C. 154(b) by 5 days.

(21) Appl. No.: 10/348,043

(22) Filed: Jan. 17, 2003

(65) Prior Publication Data

US 2003/0155324 A1 Aug. 21, 2003

Related U.S. Application Data

(63) Continuation-in-part of application No. 09/706,302, filed on Nov. 3, 2000, now Pat. No. 6,527,133.

(51) Int. Cl.[7] ..... B65D 90/02

(52) U.S. Cl. ..... 215/382; 220/600; 215/396

(58) Field of Search ..... 215/382, 380, 215/383–396, 397, 398, 399; 220/660, 669–676, 710.5, 318, 755, 756, 768, 769, 600, 608

(56) References Cited

U.S. PATENT DOCUMENTS

| | | | | | |
|---|---|---|---|---|---|
| D200,879 | S | | 4/1965 | Randlett | |
| D203,226 | S | | 12/1965 | Schnur | |
| D213,763 | S | | 4/1969 | Plummer | |
| 3,708,082 | A | * | 1/1973 | Platte | 215/385 |
| D229,670 | S | * | 12/1973 | Platte et al. | D9/531 |
| D238,654 | S | | 2/1976 | Platte | |
| 4,016,995 | A | | 4/1977 | Frazer | |
| 4,046,275 | A | | 9/1977 | Virog, Jr. et al. | |
| D256,664 | S | | 9/1980 | Burrington et al. | |
| D265,797 | S | | 8/1982 | Platte | |
| 4,372,455 | A | | 2/1983 | Cochran | |
| 4,832,211 | A | | 5/1989 | Matthews et al. | |
| 4,838,464 | A | * | 6/1989 | Briggs | 222/478 |
| 4,846,359 | A | | 7/1989 | Barid et al. | |
| D302,946 | S | | 8/1989 | Cramer | |
| D332,747 | S | | 1/1993 | Darr et al. | |
| 5,318,787 | A | | 6/1994 | Brauner et al. | |
| D348,612 | S | | 7/1994 | Ring | |
| D360,830 | S | | 8/1995 | Hestehave et al. | |
| D376,761 | S | * | 12/1996 | Lathrop et al. | D9/528 |
| D387,277 | S | * | 12/1997 | Dixon et al. | D9/528 |
| 5,704,506 | A | | 1/1998 | Tobias et al. | |
| D391,854 | S | | 3/1998 | Ankney et al. | |

(Continued)

*Primary Examiner*—Lien M. Ngo
(74) *Attorney, Agent, or Firm*—Dorsey & Whitney LLP

(57) ABSTRACT

A container including a plurality of side walls, a top, a handle, a bumper, and a substantially planar label surface. The top has a neck and is joined to a top portion of the side walls. The handle is formed in a region adjacent the top and extends between two adjacent side walls within the profile of the container. The bumper extends around the periphery of the container across each of the side walls. The bumper projects outward from each of the side walls a distance. The substantially planar label surface is located on one of the side walls proximal the bumper and extends upwardly higher than a lower end portion of the handle. The distance is sufficient to prevent contact of the label surface against a flat surface abutting against the container. The bumper may be offset downwardly to extend around the label surface thereby enlarge the label surface. The container may include a plurality of corner portions interconnecting adjacent side walls. Each corner portion may include a downward facing shoulder located intermediate the bumper and the top. The shoulders may define a recessed portion of the corner portion extending between the bumper and the shoulder. The recessed portion may be adapted for receiving a flexible-sleeve label.

28 Claims, 5 Drawing Sheets

U.S. PATENT DOCUMENTS

| | | | | | |
|---|---|---|---|---|---|
| D392,188 | S | | 3/1998 | Darr et al. | |
| D401,154 | S | * | 11/1998 | Robinson | D9/528 |
| 5,833,115 | A | | 11/1998 | Eiten | |
| D404,649 | S | * | 1/1999 | Meisner et al. | D9/531 |
| D408,739 | S | * | 4/1999 | Satterfield et al. | D9/520 |
| D415,035 | S | | 10/1999 | Ankney et al. | |
| D418,423 | S | | 1/2000 | Lauth, III et al. | |
| D427,076 | S | * | 6/2000 | Ankney et al. | D9/531 |
| D427,912 | S | * | 7/2000 | Johnson et al. | D9/528 |
| 6,237,792 | B1 | * | 5/2001 | Skolnicki et al. | 215/382 |
| D446,127 | S | * | 8/2001 | Adee et al. | D9/563 |
| D448,976 | S | | 10/2001 | McDonough et al. | |
| D462,616 | S | * | 9/2002 | Scheida | D9/528 |
| D472,815 | S | * | 4/2003 | Zhang et al. | D9/538 |

* cited by examiner

MULTIPLE LABEL CONTAINER

CROSS-REFERENCES TO RELATED APPLICATIONS

This application is a Continuation-in-Part of U.S. patent application Ser. No. 09/706,302, filed Nov. 3, 2000 now U.S. Pat. No. 6,527,133, and entitled MULTIPLE LABEL CONTAINER, the entire contents of which is incorporated herein by this reference.

BACKGROUND OF THE INVENTION

1. Field of the Invention

The present invention relates to a new and improved multi-label container, and more particularly, to a container configured to receive and protect multiple labels applied thereon.

2. Description of Related Art

Blow molded thin-walled plastic bottles are conventionally used to hold liquids and beverages, and are particularly suited to hold milk, water, and juice. For example, thin-walled light weight milk containers have been used commercially in a variety of standardized sizes including one-gallon, three-quart, half-gallon, one-quart, and other sizes. These standard size containers have a generally standardized square or rectangular shape, as is well known.

An exemplar of known thin-walled plastic bottles is U.S. Pat. No. 4,372,455 to Cochran which shows a thin-walled plastic container construction. U.S. Pat. No. 4,046,275 to Virog, Jr. et al. discloses a milk bottle having a horizontal band for stiffening the container and a volumetric insert for fine adjustments to the volume of the molded container. U.S. Pat. No. 5,704,506 discloses a container having an attached handle.

Plastic containers having a square or rectangular shape, including those disclosed above, have been found to be more suitable than other types of plastic containers for use in applications where a relatively high degree of mechanical and automated processing is involved, such as automatic filling procedures. Generally, such plastic containers have four generally flattened side walls interconnected by curved corner portions. A handle is often integrally formed on the container and constructed as to not extend beyond the perimeter of the container.

Generally such thin-walled plastic bottles are conveyed along an automatic filling line of a bottling and packaging plant and packed for shipment into a carrying case such as a milk crate. Because the handle does not extend beyond the perimeter, regardless of how the container is fed into a filling line, carrying case or the like, the container handle does not interfere with the motion of the container. Furthermore, such thin-walled plastic bottles have a high degree of standardization with respect to size and shape, as noted above, in order to facilitate motion along a filling line and placement into a carrying case.

When traveling along the filling line, a wall of one plastic bottle abuts directly against a wall of another adjacent plastic bottle. Although such contact between bottles is desirable because it serves to convey the bottles along a filling line, such contact is disadvantageous because it causes wear and other damage to any labels applied to the bottles. Such wear and other damage affects the aesthetics of the bottle which may in turn affect a consumer's decision when purchasing a plastic bottle product.

Milk and water bottles are conventionally transported from dairies and water bottling plants to retail outlets in rectangular carrying cases which are standard in much of the industry. The bodies of trucks employed to transport them and the dimensions of conveyors used to handle them are similarly standardized to conform to the standard case size.

When known thin-walled plastic bottles are filled and loaded into a standard carrying case, two or three walls of one bottle directly abut against and contact two or three other bottles. Such contact may also cause wear and other damage to any label applied to the bottles.

Known thin-walled plastic bottles have the further disadvantage of being configured to receive only one type of label. For example, a known conventional plastic bottle has a flat surface adapted to receive an adhesive label. Such known plastic bottles, however, are ill-suited for receiving a plastic-sleeve type label because the known plastic bottles lack means to prevent the plastic-sleeve label from slipping off the bottle after the label has been applied.

What is needed is an improved thin-walled plastic container which readily accepts a variety of labels and is configured to protect the labels.

BRIEF SUMMARY OF THE INVENTION

In summary, a thin-walled multi-label container in accordance with the present invention generally includes side walls, a bottom, a top having a neck, a handle, one or more label surfaces and a bumper. Comer portions interconnect adjacent side edge portions of respective side walls. A curved base portion interconnects an adjacent bottom edge portion of a respective side wall with an adjacent edge portion of the bottom. A curved crown portion interconnects an adjacent top edge portion of a respective side wall with an adjacent edge portion of the top. The handle is formed in a region extending along one of the curved corner portions within the profile of the container and provides an aperture for receiving the fingers of a user. The label surfaces are located on respective side walls. The bumper extends around the periphery of the container across each of the upstanding side walls and projects outward from each of the side walls a distance sufficient to prevent contact of the label surfaces against any flat surface abutting against the container. The container also includes a downward facing shoulder located on a corner portion located intermediate the bumper and the top which defines a recessed portion of the corner portion which extends between the bumper and the shoulder. The recessed portion is adapted to receive a flexible sleeve label.

Another aspect of the present invention is directed to a container including a plurality of side walls, a top, a handle, a bumper, and a substantially planar label surface. The top has a neck and is joined to a top portion of the side walls. The handle is formed in a region adjacent the top and extends between two adjacent side walls within the profile of the container. The bumper extends around the periphery of the container across each of the side walls. The bumper projects outward from each of the side walls a distance. The substantially planar label surface is located on one of the side walls proximal the bumper and extends upwardly higher than a lower end portion of the handle. The distance is sufficient to prevent contact of the label surface against a flat surface abutting against the container.

In one embodiment, the bumper may be continuous. The bumper may be offset downwardly to extend around the label surface thereby enlarge the label surface. The handle may form an aperture for receiving the fingers of a user and the label surface may extend upwardly above the lower end of the aperture. The container may include a second label surface on another side wall. The second label surface may be proximal the bumper and may extend upwardly higher than a lower end portion of the handle. The container may include a plurality of corner portions interconnecting adjacent side walls. Each corner portion may include a downward facing shoulder located intermediate the bumper and the top. The shoulder may define a recessed portion of the corner portion extending between the bumper and the shoulder. The recessed portion may be adapted for receiving a flexible-sleeve label. At least one of the corner portions may include a corner rib for added structural integrity. The container may include a strengthening rib located on the top adjacent the neck. The strengthening rib may include a rib extension extending outwardly from the neck.

Yet another aspect of the present invention is directed to a container including a plurality of side walls, a plurality of corner portions, a top, a handle, an upward facing shoulder, a downward facing shoulder, and a substantially planar label surface. The corner portions interconnect adjacent side walls. The top has a neck and is joined to a top portion of the side walls. The handle is formed in a region adjacent the top and extends between two adjacent side walls within the profile of the container. The upward facing shoulder is located on at least one of the corner portions. The downward facing shoulder is located on the at least one the corner portion intermediate the upward facing shoulder and the top. The shoulders define a recessed portion of the corner portion extending therebetween, wherein the recessed portion is adapted for receiving a flexible-sleeve label. The substantially planar label surface located on one of the side walls proximal the upward facing shoulder and extending upwardly higher than the downward facing shoulder.

In one embodiment, the container may include a bumper extending around the periphery of the container and across each of the four upstanding side walls. The bumper may project outward from each of the side walls a distance which is sufficient to prevent contact of the planar label surface against a flat surface abutting against the container. The bumper may form the upward facing shoulder. The bumper may be continuous. The bumper may be offset downwardly to extend around the planar label surface thereby enlarging the planar label surface. The handle may form an aperture for receiving the fingers of a user, and the planar label surface may extend upwardly above a lower end of the aperture. The container may include a second label surface on another side wall proximal the bumper and extending upwardly higher than a lower end portion of the handle. At least one the corner portion may include a corner rib for added structural integrity. A strengthening rib may be located on the top adjacent the neck. The strengthening rib may include a rib extension extending outwardly from the neck.

Yet another aspect of the present invention is directed to a container including a plurality of side walls, a plurality of corner portions interconnecting adjacent side walls, a top having a neck, the top joined to a top portion of the side walls, a handle formed generally in a region adjacent the top and extending between two adjacent side walls within the profile of the container, and a strengthening boss located on the top adjacent the neck, the strengthening rib including a rib extension extending outwardly from the neck along a top portion of the handle. The strengthening boss may include a plurality of supplemental ribs extending outwardly from the neck. Each supplemental rib may extend outwardly toward a respective one of the corner portions. The container may include an upward facing shoulder located on at least one of the corner portions, a downward facing shoulder located on the at least one the corner portion intermediate the upward facing shoulder and the top, the shoulders defining a recessed portion of the corner portion extending therebetween, wherein the recessed portion is adapted for receiving a flexible-sleeve label, and a substantially planar label surface located on one of the side walls proximal the upward facing shoulder and extending upwardly higher than the downward facing shoulder.

The container may include a bumper extending around the periphery of the container and across each of the four upstanding side walls, the bumper projecting outward from each of the side walls a distance, the distance being sufficient to prevent contact of the planar label surface against a flat surface abutting against the container. The bumper may form the upward facing shoulder.

An object of the present invention is to provide a thin-walled multi-label container having a bumper configured to protect a label of the container against contact with a flat surface abutting against the container.

Thus, it is an object of the present invention to provide a thin-walled multi-label container having means to minimize and/or prevent label wear and damage due to contact with abutting surfaces, including similar abutting containers in a filling line or in a carrying case.

It is another object of the present invention to provide a thin-walled multi-label container configured to accept multiple labels of various sizes and types, including large and small adhesive, painted labels, and flexible sleeve labels.

The multiple label container of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
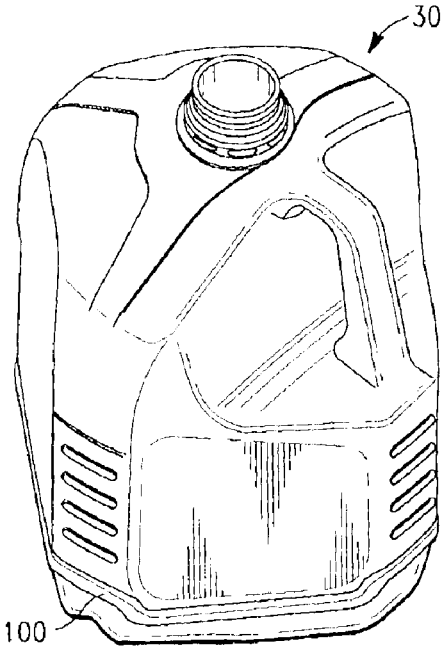
FIG. 1 is a perspective view of a multi-label container in accordance with the present invention.

Turning now to the drawings, wherein like components are designated by like reference numerals throughout the various figures, attention is directed to FIG. 1. A thin-walled, multi-label container in accordance with the present invention is ideally suited for the storage and distribution of liquids, including but not limited to various beverages such as milk, juice, and bottled water. The illustrated container has volume of approximately one-gallon, however, one should appreciate that the container may have different volumes. For example, the container of the present invention can be made in three-quart, half-gallon, and one-quart sizes.

Preferably, the container has a square plan profile and generally has four flat upstanding side walls which are interconnected by four curved corner portions. One should appreciate, however, that the container is equally suitable for use with other polygonal profiles such as rectangular and triangular profiles. The container is integrally formed with a handle along one corner. In accordance with the present invention, the container further includes a bumper band and a label retention recess.

Figure 2:
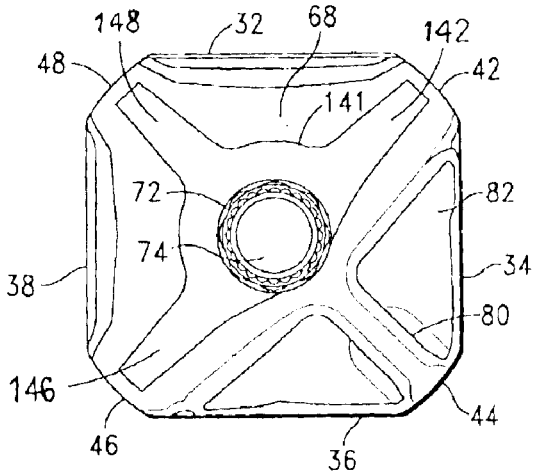
FIG. 2 is a top plan view of the multi-label container of FIG. 1 having first, second, third and fourth side walls.
Figure 6:
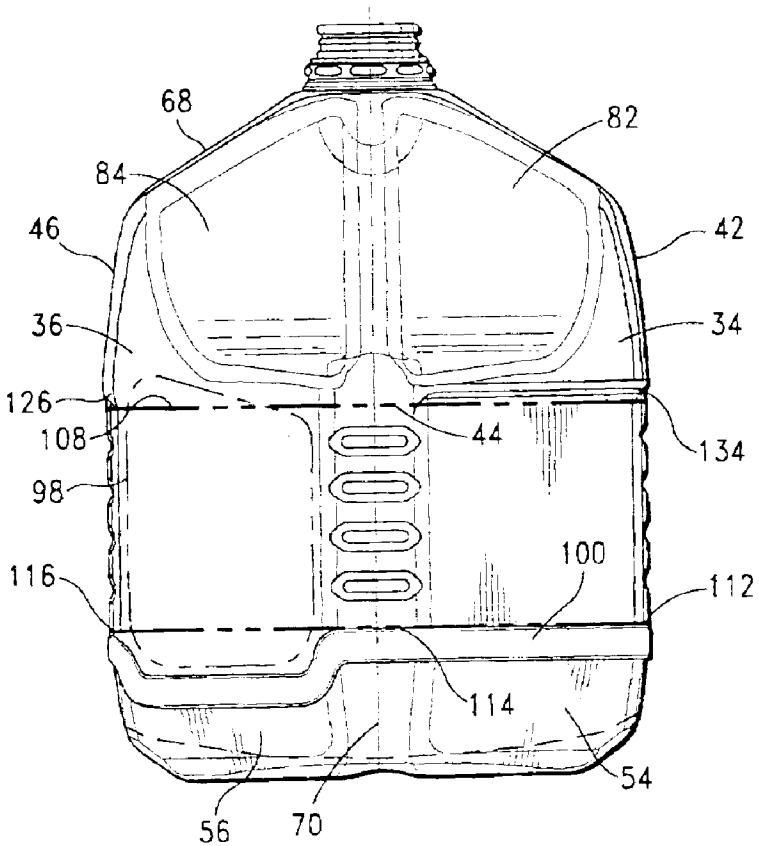
FIG. 6 is an elevational view of the second and third side walls of the container of FIG. 1.
Figure 7:
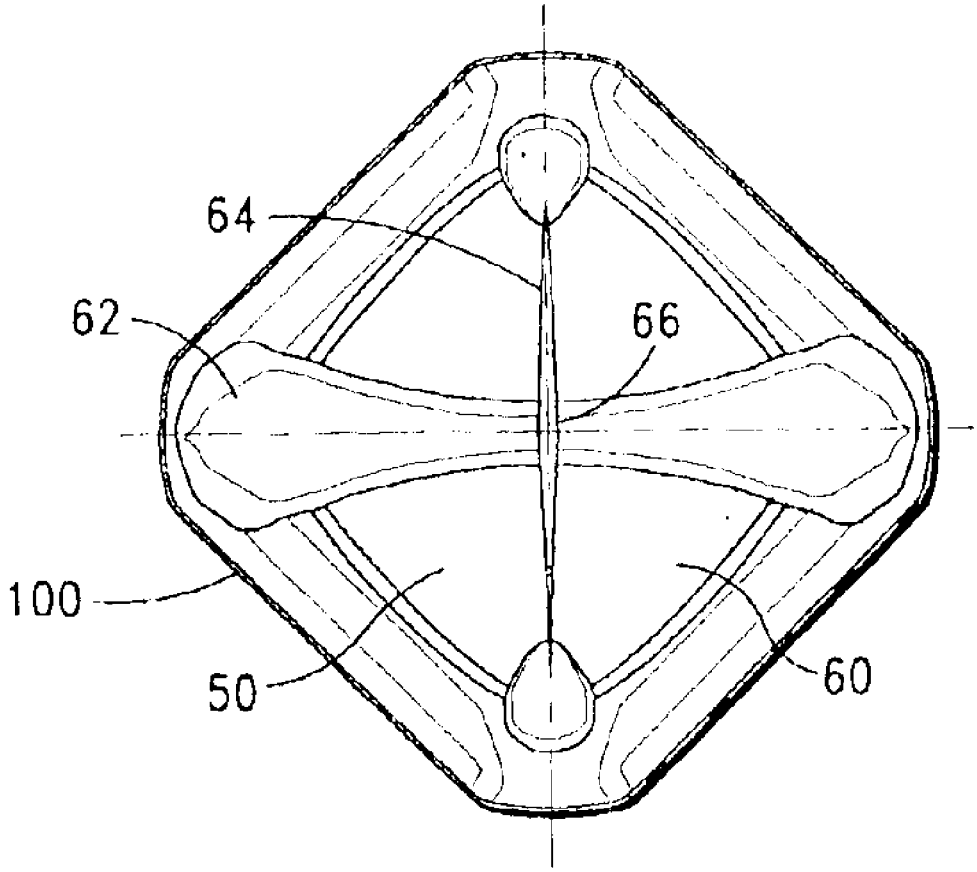
FIG. 7 is a bottom plan view of the container of FIG. 1.

Referring generally to FIG. 2 through FIG. 7, a one-gallon size container in accordance with the present invention is designated by the numeral 30. Container 30 is blow molded and includes a one piece thin-walled construction having four generally flat side walls designated, respectively, as 32, 34, 36 and 38 and interconnected by curved corner portions designated, respectively, as 42, 44, 46 and 48. The side walls and curved corner portions together form a generally square configuration when viewed in longitudinal section or in top or bottom plan views, as is shown in FIG. 2 and FIG. 7, respectively.

Container 30 includes a bottom 50 which is interconnected to respective side walls 32, 34, 36 and 38 by respective curved base portions 52, 54, 56, and 58. Bottom 50 has a centrally located dished or concave section 60. Bottom 50 of the container may be suitably constructed for good pinch-off characteristics during molding and also to resist deformation. For example, an angular release groove 62 tapers upwardly from a central pinch-off zone 64 at which there is formed a narrow external web 66 which intersects groove 62 as shown.

Each of side walls 32, 34, 36 and 38, and curved corner portions 42, 44, 46 and 48 are connected along their top edge portions to a domed or conically tapered top 68. The illustrated container is generally symmetrically arranged around a longitudinal axis 70. Top 68 terminates with a neck 72 having a mouth 74 which is generally symmetrically positioned about longitudinal axis 70. One should appreciate, however, that container need not be symmetrical. Instead, the container can be asymmetric having a neck and mouth which is offset from longitudinal axis 70. For example, the neck and mouth can be offset away from a handle of the container to facilitate in pouring the contents thereof.

Figure 3:
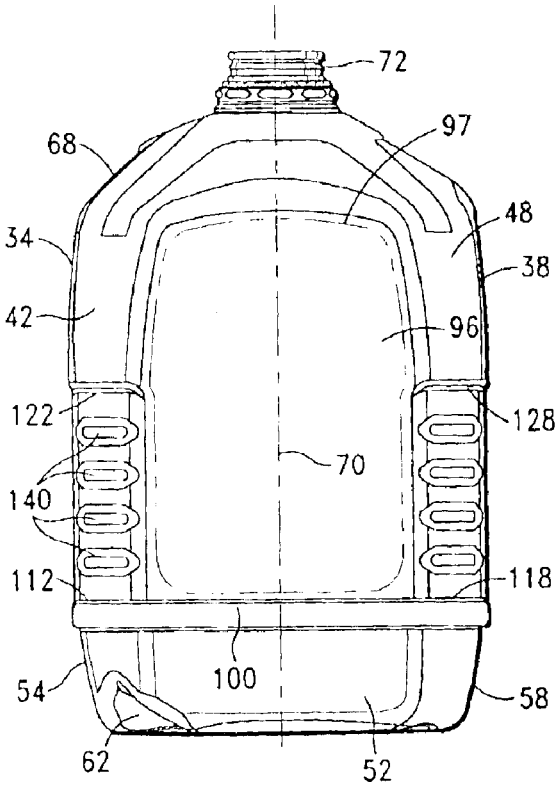
FIG. 3 is an elevational view of the first wall of the container of FIG. 1.

As shown in FIG. 2 and FIG. 3, neck 72 is integrally connected at its base to top 68. Side wall portions of neck 72 have flanged members 76 formed thereon whose configuration depends upon the exact type of closure cap to be used with container 30. In the illustrated embodiment, flange members 76 define a tamper-evident closure engaging means, such as those disclosed by U.S. Pat. No. 4,484,687 to Bullock, III. Alternatively, the neck can including flange members which define threaded cap engaging means, such as those also disclosed by U.S. Pat. No. 5,213,224 to Luch. Preferably, lugs 78 are formed at base of neck 72 which serve as graspable elements for mechanical conveying, for example lifting the containers to facilitate packing the containers into carrying cases.

Figure 5:
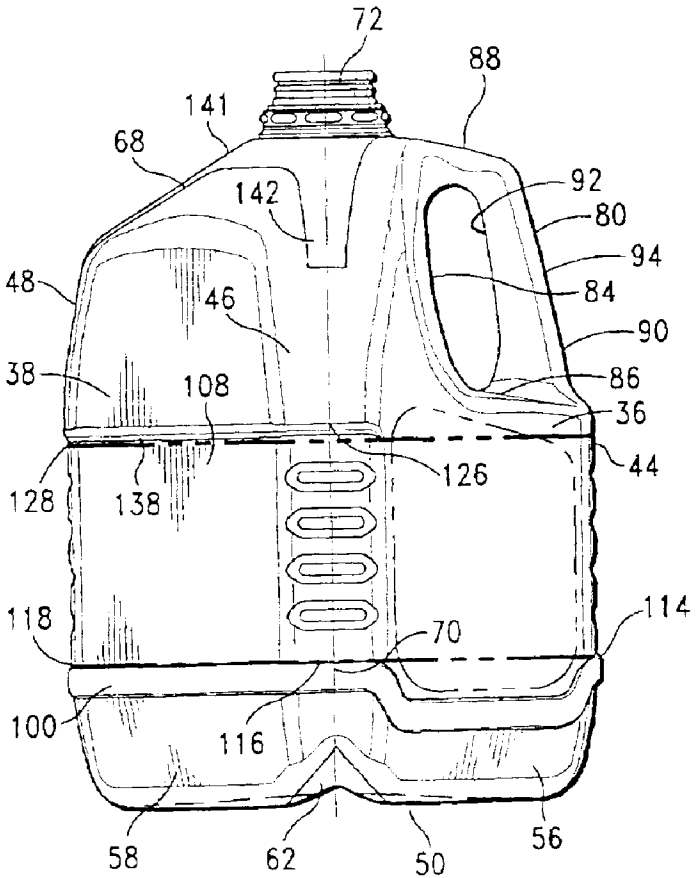
FIG. 5 is an elevational view of the third and fourth side walls of the container of FIG. 1.

Referring to FIG. 5 and FIG. 6, one corner portion 44 is modified to incorporate a hollow handle 80 integrally formed with container 30. A chamfered surface extends between adjacent side walls 34 and 36 forming an indented handle portion 82 having upper and lower indent walls 84, 86. Upper indent wall 84 is a generally planar surface which extends between adjacent side walls 34 and 36 and along a portion of top 68. Lower indent wall 86 is a generally planar surface which is generally perpendicular to upper indent wall 84 and extends between and cuts into adjacent side walls 34 and 36.

Respective upper and lower end portions 88, 90 of the handle are integrally connected with adjoining portions of container 30 forming an aperture 92 between a central portion 94 of handle 80 and upper indent wall 84 to provide a manual gripping location for a user of container 30. Preferably, aperture 92 is smoothly curved at its top and bottom to accommodate three or four fingers of a user's hands. Also, the top portion of handle 80 preferably is curved concavely to provide a thumb-engaging portion for those users who like to squeeze the top of the upright portion of handle 80 between thumb and forefinger. Lower end portion 90 of handle 80 is connected with an upper portion of corner portion 44 and lower indent wall 86.

Figure 4:
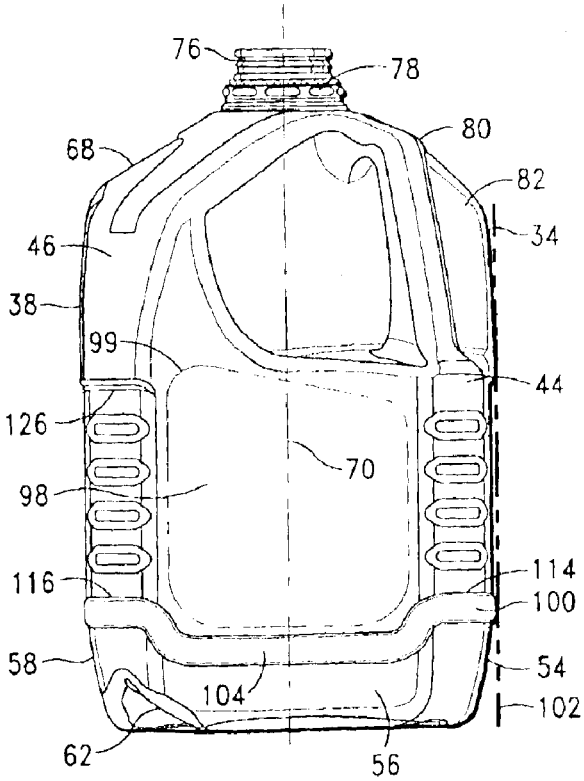
FIG. 4 is an elevational view of the third side wall of the container of FIG. 1.

As shown in FIG. 3 and FIG. 4, container 30 is provided with one or more label surface areas 96, 98 to which one or more adhesive labels, such as labels 97 and/or 99, as shown in phantom, can be attached. Alternatively, label surface areas 96, 98 provide a surface to which identifying indicia or ornamental graphics can be applied, for example, by painting, printing, silk-screening or other suitable means. Accordingly, the contents of container 30, the source of the contents or container 30 may be conveniently identified.

As shown in FIG. 3, a first substantially planar label surface area 96 is provided on first side wall 32. As shown in FIG. 3, first planar label surface 96 extends from a bumper 100 above lower end portion 90 of handle 80 (shown in FIG. 1 and FIG. 6). In one embodiment, first planar label surface area 96 occupies a major portion of side wall 32 to accommodate a label 97 (shown in phantom) having a surface area more than one-half the surface area of side wall 32. First planar label surface area 96 may occupy 75%–100% of the surface area of side wall 32. First label surface area 96 is provided in side wall 32 which is not interrupted by the chamfered surface of handle 80 and thus provides a relatively large label surface area. Preferably, first label surface area 96 occupies the majority of the surface area of first side wall 32 thus providing an area sufficient to receive a large label 97.

A second substantially planar label surface area 98 is provided on third side wall 36 opposite from first label surface area 96, as is shown in FIG. 4. Second planar label surface 98 extends above lower end portion 90 of handle 80, as shown in FIG. 1 and FIG. 6. In one embodiment, second planar label surface area 98 occupies a major portion of side wall 36 to accommodate a label 99 (shown in phantom)

having a surface area more than one-half the surface area of side wall 38. Second planar label surface area 98 may occupy 75%–100% of the surface area of side wall 38. Because second label surface area 98 is located on a side wall which is interrupted by the chamfered surface of handle 80, second label surface area 98 is smaller than first label surface area 96. Similar to first label surface area 96, second label surface area 98 occupies the majority of third side wall 36 thus providing an area sufficient to receive a relatively large label 99.

One should appreciate that container 30 may include other labeling configurations. For example, the container may include two label surface areas located on adjacent side walls, thus providing two label surface areas capable of receiving either two large labels, two small labels, or one large label and one small label.

As shown in FIG. 1, container 30 further include a bumper band 100 which extends around periphery of container 30. Bumper band 100 is formed integrally with container 30 during the blow-molding process. Bumper band 100 extends substantially horizontally across each of upstanding side walls 32, 34, 36 and 38 and across interconnecting corner portions 42, 44, 46 and 48. Bumper band 100 projects outward from each of side walls 32, 34, 36 and 38 a distance that is sufficient to prevent contact of first label surface area 96 against any flat surface abutting against container 30. For example, bumper band 100 prevents the sidewall of another adjacent container from contacting a label applied to first label surface area 96 when the containers move along a filling line or are packed in a carrying case. An exemplary flat surface is indicated in phantom and designated by numeral 102 in FIG. 4.

Bumper band 100 generally extends outwardly from side walls 32, 34, 36 and 38 in the range of approximately 0.020–0.100 inches, and is preferably 0.040 inches. Bumper band 100 has a width which is sufficient to provide a sufficient contact area for abutting adjacent surfaces but it is not so wide as to significantly detract from the label surface area. Preferably, bumper band 100 is approximately in the range of approximately 0.125–0.750 inches and is preferably 0.375 inches in height. As can be seen in FIG. 1, bumper band 100 does not significantly affect the appearance of the overall appearance of container 30 or its ability to be packed four, six or eight to a standard carrying case.

The illustrated bumper band 100 generally has a uniform depth and width, however, one should appreciate that other configurations can be used. For example, the bumper band can be wider as it approaches the corner portion than the band is at the center of the side walls. Alternatively, the bumper band can be wider or deeper on the larger side walls adjacent larger label surface areas in order to provide increased protection for the larger label surface areas. Alternatively, the band may be segmented instead of continuous around the entire periphery of container 30. One should also appreciate that the bumper need not be positioned at the lower edge of the side walls and instead could be provided at the middle portion or top edge of the side walls and provide a degrees of label protection.

As shown in FIG. 4, bumper band 100 preferably has an offset portion 104 located on third sidewall 36. Offset portion 104 is offset downwardly to accommodate a larger surface area but still provides protection against abutting flat surfaces. Although offset portion 104 is shown on third side wall 36, one should appreciate that an offset portion may be provided on a different side wall in addition or instead of third side wall 36. For example, the offset portion of the bumper can be provided on a side wall that is not interrupted by indented handle portion 82 thus providing an even larger label area surface.

The thin-walled multi-label container 30 according to the present invention further includes structure that is adapted to receive a flexible tubular plastic-sleeve label 108. In particular, container 30 includes an upward facing shoulder 112, 114, 116 and 118 located on each of corner portions 42, 44, 46 and 48 proximal to a respective curved base portion 52, 54, 56 and 58. Container 30 further includes a downward facing shoulder 122, 126 and 128 located on three of corner portions 42, 46 and 48 intermediate a respective upward facing shoulder 112, 116, and 118 and top 68 of container 30. Together, the shoulders define a recessed portion of each corner portion extending between the shoulders. The shoulders extend in the range of approximately 0.020–0.080 inches, and preferably 0.040 inwardly from the respective corner portions thus providing a recess that is particularly well suited to receive sleeve label 108 around the periphery of container 30. The dimensions of the recess also prevent or minimize the likelihood of plastic-sleeve label 108 from slipping off from container 30 once it has be applied to container 30. Although the illustrated embodiment does not show a downward facing shoulder on corner portion 44, one should appreciate that a similar downward facing shoulder can be provided to further promote plastic-sleeve label retention on container 30.

As shown in FIG. 3 through FIG. 6, bumper band 100 extends across corner portions 42, 44, 46 and 48 and thus forms upward facing shoulders 112, 114, 116 and 118. Thus, bumper band 100 not only prevents an abutting flat surface from contacting the label surface areas but also serves as a shoulder that prevents plastic-sleeve label 108 applied to container 30 from sliding down container 30 below its intended position. In the case that bumper band 100 is continuous and encircles container 30, bumper band 100 forms a respective upward facing shoulder 112, 114, 116 and 118 on each of corner portions 42, 44, 46 and 48.

As shown in FIG. 5 and FIG. 6, a side wall may also be provided with a downward facing shoulder. In particular, side walls 34 and 38 are each provided with downward facing wall shoulders 134 and 138 and serve the same function as downwardly facing shoulders 122, 126 and 128, namely, positioning plastic-sleeve label 108 on container 30 and preventing it from slipping off container 30. Because bumper band 100 also extends across the walls 34 and 38, the bumper band also serves as an upward facing shoulder which complements downward facing wall shoulders 134 and 138. The illustrated embodiment has a downward facing wall shoulder 134, 138 on opposing side walls 34, 38 and thus provides effective label retention. However, one should appreciate that a downward facing wall could be provided on each side wall and fall within the scope of the present invention.

As shown in FIG. 3, one or more corner ribs 140 are provided on corner portions 42, 44, 46 and 48 to provide additional structural integrity of container 30. In particular, corner ribs 140 may be horizontally extending elongated indentations that are vertically arranged along the recessed portions of corner portions 42, 44, 46 and 48 as is shown in FIG. 3 through FIG. 6. One should appreciate that the ribs may have various shapes and configures. For example, the ribs may be alternatively be circular or square shaped and may be in the form of indentations, as shown in the Figures. Alternatively, the ribs can be protrusions which extend outwardly from the recess portion so long as the protrusions do not extend further out that the shoulders and negate the plastic-sleeve holding ability of the shoulders.

Container 30 is preferably molded of high density polyethylene which is conventionally used for plastic juice, milk and water containers. It is also within the scope of the invention to use other polymers such as polypropylene, polyethylene terephthalate (PET) and glycol modified polyethylene terephthalate (PET G) Once molded, any excess material or flash is trimmed from container 30. The container is decorated by various means to identify the contents of the container, the manufacturer or source of the container and/or the contents thereof. For example, an adhesive label may be applied to either the first or second label surfaces. Alternatively, identifying information or graphic ornamentation can be applied by painting or silk-screening either the first or second label surfaces. Furthermore, a plastic-sleeve label could be applied around the container instead of or in addition to labels or other ornamentation.

The container is then filled directly or some time thereafter. One should appreciate, however, that the container may be filled before, during, and/or after one or more labels are applied to the container. Certain adjustments to the mold cavity will generally be made to bring the capacity of the container to the standardized volume of the container (e.g., one-gallon, one-quart, etc.). Such volume adjustments are conventional and are accomplished by selecting and utilizing a replaceable volumetric insert or plug.

Because container 30 of the present invention has a substantially square profile, it is readily adapted for conveyance along a filling line during automated and semiautomatic filling and loading operations. Container 30 is also readily adapted for storage and shipment. In particular, because container 30 is substantially square or rectangular shaped, it readily fits within standard carrying cases and refrigeration cases. For example, container 30 in accordance with the present invention is readily adapted to fit within a carrying case, such as a common a milk crate, so that four similarly shaped one-gallon containers can be fitted into the case.

Bumper band 100 effectively prevents an abutting flat surface, such as an adjacent side wall of an abutting container, from contacting label surface areas 96, 98 and the recessed sleeve label area of container 30. Because contact is minimized and/or prevented, wear and other damage to labels 97, 99 and/or 109 affixed to labels surface areas 96 and 98 and/or to sleeve label 108, respectively, is thus minimized and/or prevented.

Container 30 includes a strengthening top rib 141 located on and extending upwardly from top 68. Strengthening top rib 141 is optionally provided to improve the structural integrity and the top load strength of the container. Such a strengthening top rib is advantageous to minimize or prevent deformation of the containers in the event that containers are stacked upon one another, for example, when a plurality of containers are stacked in column three, four, or more container high.

Strengthening top rib 141 includes three strengthening rib extensions 142, 146, 148 which extend outward toward corner portions 42, 46, 48, respectively. One should appreciate that the strengthening top rib may take various forms and still fall within the scope of the present invention. For example, the strengthening top rib may have the same wall thickness as the top and or side walls of the container. Alternatively, the strengthening top rib may have a greater wall thickness than other portions of the container. One should also appreciate that strengthening top rib may include one, two, three or more strengthening rib extensions.

In another embodiment of the present invention, container 30*a* is similar to container 30 described above but includes a one-half gallon configuration with different dimensions and a different volume, as shown in FIG. 8 through FIG. 13. Like reference numerals have been used to describe like components of container 30 and 30*a*.

Figure 8:
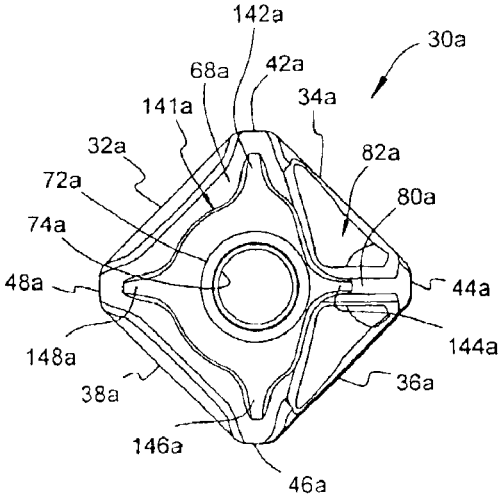
FIG. 8 is a top plan view of another multi-label container in accordance with the present invention, the multi-label container having first, second, third and fourth side walls.
Figure 13:
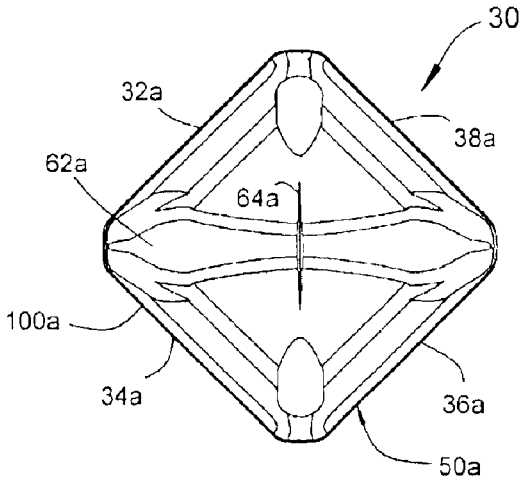
FIG. 13 is a bottom plane view of the multi-label container of FIG. 8.

Referring generally to FIG. 8 through FIG. 13, a one-half gallon container in accordance with the present invention is generally designated by the numeral 30*a*. Container 30*a* is blow molded and includes a one piece thin-walled construction having four generally flat side walls designated, respectively, as 32*a*, 34*a*, 36*a* and 38*a* and interconnected by curved corner portions designated, respectively, as 42*a*, 44*a*, 46*a* and 48*a*. The side walls and curved corner portions together form a generally square configuration when viewed in longitudinal section or in top or bottom plan views, as is shown in FIG. 8 and FIG. 13, respectively.

Container 30*a* includes a bottom 50*a* which is interconnected to respective side walls 32*a*, 34*a*, 36*a* and 38*a* by respective curved base portions. Each of side walls 32*a*, 34*a*, 36*a* and 38*a*, and curved corner portions 42*a*, 44*a*, 46*a* and 48*a* are connected along their top edge portions to a domed or conically tapered top 68*a*. Top 68*a* terminates with a neck 72*a* having a mouth 74*a*.

Figure 9:
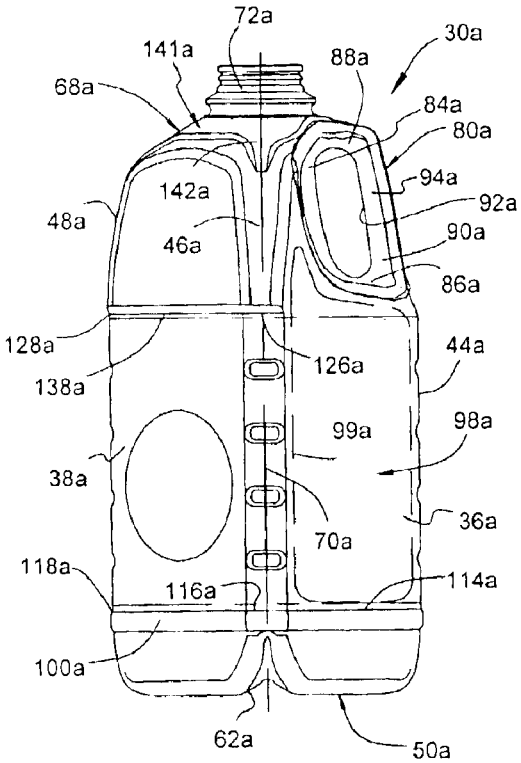
FIG. 9 is an elevational view of the third and fourth side walls of the multi-label container of FIG. 8.

Referring to FIG. 9, one corner portion 44*a* is modified to incorporate a hollow handle 80*a* integrally formed with container 30*a*. A chamfered surface extends between adjacent side walls 34*a* and 36*a* forming an indented handle portion 82*a* having upper and lower indent walls 84*a*, 86*a*. Upper indent wall 84*a* is a generally planar surface which extends between adjacent side walls 34*a* and 36*a* and along a portion of top 68*a*. Lower indent wall 86*a* is a generally planar surface which is generally perpendicular to upper indent wall 84*a* and extends between and cuts into adjacent side walls 34*a* and 36*a*.

Respective upper and lower end portions 88*a*, 90*a* of the handle are integrally connected with adjoining portions of container 30*a* forming an aperture 92*a* between a central portion 94*a* of handle 80*a* and upper indent wall 84*a* to provide a manual gripping location for a user of container 30*a*. Preferably, aperture 92*a* is smoothly curved at its top and bottom to accommodate fingers of a user's hands. Also, the top portion of handle 80*a* preferably is curved concavely to provide a thumb-engaging portion for those users who like to squeeze the top of the upright portion of handle 80 between thumb and forefinger. Lower end portion 90*a* of handle 80*a* is connected with an upper portion of corner portion 44*a* and lower indent wall 86*a*.

Figure 10:
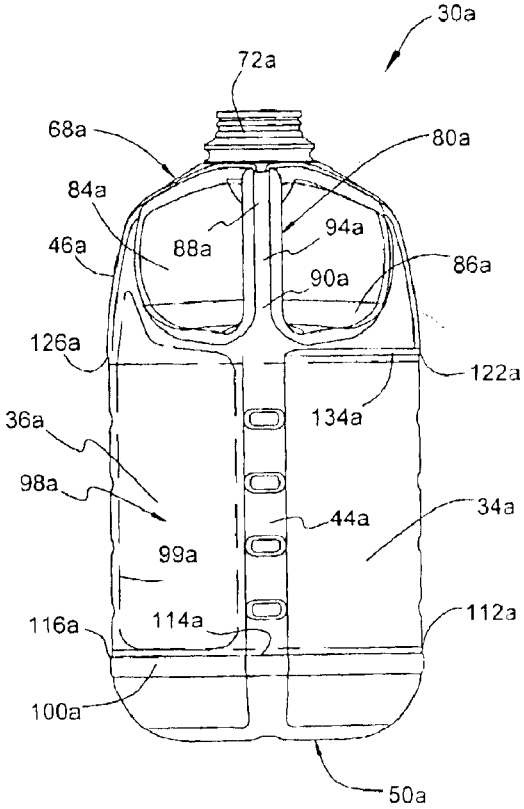
FIG. 10 is an elevational view of the second and third side walls of the multi-label container of FIG. 8.
Figure 11:
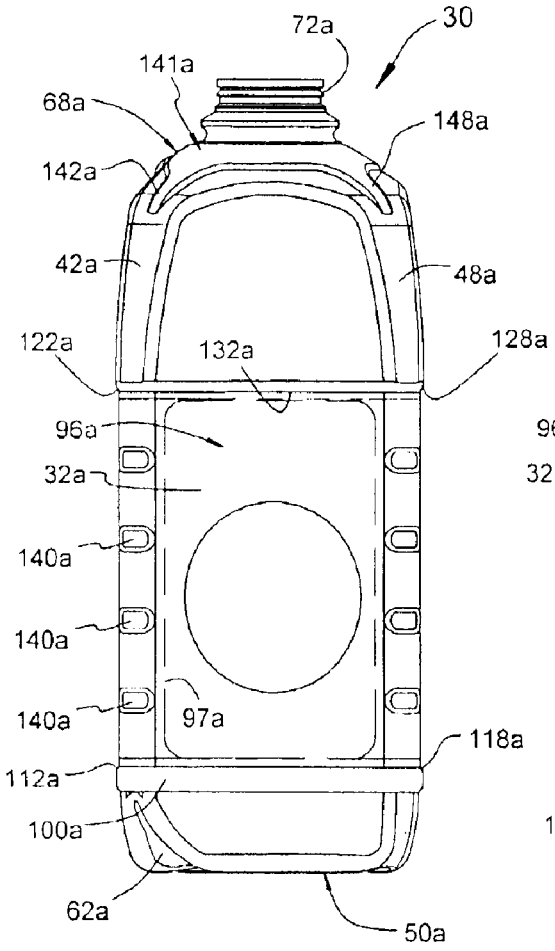
FIG. 11 is an elevational view of the first side wall of the multi-label container of FIG. 8.
Figure 12:
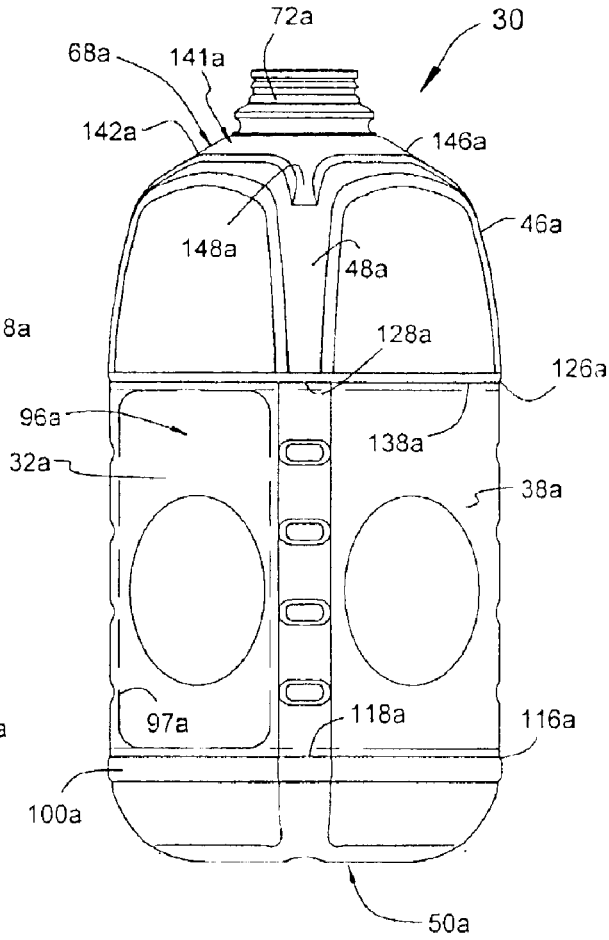
FIG. 12 is an elevational view of the first and fourth side walls of the multi-label container of FIG. 8.

In the embodiment shown in FIG. 8 through FIG. 13, container 30*a* is provided with one or more label surface areas 96*a*, 98*a* to which one or more adhesive labels, such as labels 97*a* and/or 99*a*, as respectively shown in phantom in FIG. 9 and FIG. 11, can be attached. Alternatively, label surface areas 96*a*, 98*a* provide a surface to which identifying indicia or ornamental graphics can be applied, for example, by painting, printing, silk-screening or other suitable means in a manner similar to that described above. Accordingly, the contents of container 30*a*, the source of the contents, and/or the source of container 30*a* may be conveniently identified. One should appreciate that container 30*a* may be provided with one, two, three or more planar label surface areas in accordance with the present invention.

In the embodiment of FIG. 11, a first substantially planar label surface area 96*a* is provided on first side wall 32*a*. In this embodiment, first planar label surface area 96*a* occupies a portion of side wall 32*a* which extends between bumper band 100*a* and downward facing wall shoulder 132*a* to accommodate a label 97*a* (shown in phantom). In this embodiment, first planar label surface area 97*a* occupies a portion of side wall 32*a* having a surface area less than one-half the surface area of side wall 32*a*. One should appreciate, however, that first label surface area 96*a* may be configured to occupy the majority of the surface area of first side wall 32*a* in the same manner as first label surface 96 described above in order to provide an area sufficient to receive a large label that extends the majority of the height of the container. In this embodiment, similar planar label surfaces may be provided on second side wall 34*a* and/or fourth side wall 38*a*.

A second substantially planar label surface area 98*a* is provided on third side wall 36*a* opposite from first label surface area 96*a*, as is shown in FIG. 9 and FIG. 10. Preferably, second planar label surface area 98*a* occupies a major portion of side wall 36*a* above bumper band 100*a* to accommodate a label 99*a* (shown in phantom). As shown in FIG. 9, second planar label surface area 98*a* extends above lower end portion 90*a* of handle 80*a* thus providing a larger, substantially planar surface than prior containers. The second planar label surface may have a surface area more than one-half the surface area of side wall 38*a*, and preferably 75%–100% the surface area of side wall 38*a*. Thus, second label surface area 98*a* occupies the majority of third side wall 36*a* thus providing an area sufficient to receive a relatively large label 99*a*.

As shown in FIG. 9, container 30*a* further includes a bumper band 100*a* which extends around periphery of container 30*a*. Bumper band 100*a* is formed integrally with container 30*a* during the blow-molding process. Bumper band 100*a* extends substantially horizontally across each of upstanding side walls 32*a*, 34*a*, 36*a* and 38*a* and across interconnecting corner portions 42*a*, 44*a*, 46*a* and 48*a*. Bumper band 100*a* projects outward from each of side walls 32*a*, 34*a*, 36*a* and 38*a* a distance that is sufficient to prevent contact of label surface areas 96*a* and 98*a* against any flat surface abutting against container 30*a* in the same manner as bumper band 100 described above.

The thin-walled multi-label container 30*a* according to the present invention also includes structure that is adapted to receive a flexible tubular plastic-sleeve label 108*a*. In particular, container 30*a* includes an upward facing shoulder 112*a*, 114*a*, 116*a* and 118*a* located on each of corner portions 42*a*, 44*a*, 46*a* and 48*a* proximal to bottom 50*a*. Container 30*a* further includes a downward facing shoulder 122*a*, 126*a* and 128*a* located on three corner portions 42*a*, 46*a* and 48*a* intermediate a respective upward facing shoulder 112*a*, 116*a*, and 118*a* and top 68*a* of container 30*a*. Together, the shoulders define a recessed portion of each corner portion extending between the shoulders. The shoulders extend in the range of approximately 0.020–0.080 inches, and preferably 0.040 inwardly from the respective corner portions thus providing a recess that is particularly well suited to receive sleeve label 108*a* (shown in phantom) around the periphery of container 30*a*. The dimensions of the recess also prevent or minimize the likelihood of plastic-sleeve label 108*a* from slipping off from container 30*a* once it has been applied to container 30*a*. Although the illustrated embodiment does not show a downward facing shoulder on corner portion 44*a*, one should appreciate that a similar downward facing shoulder can be provided to further promote plastic-sleeve label retention on container 30*a*.

As shown in FIG. 9 through FIG. 12, bumper band 100*a* extends across corner portions 42*a*, 44*a*, 46*a* and 48*a* and thus forms upward facing shoulders 112*a*, 114*a*, 116*a* and 118*a*. Thus, bumper band 100*a* not only prevents an abutting flat surface from contacting the label surface areas but also serves as a shoulder that prevents plastic-sleeve label 108*a* applied to container 30*a* from sliding down container 30*a* below its intended position.

As shown in FIG. 9 through FIG. 12, a side wall may also be provided with a downward facing shoulder. In particular, side walls 34*a* and 38*a* are each provided with downward facing wall shoulders 134*a* and 138*a* and serve the same function as downwardly facing shoulders 122*a*, 126*a* and 128*a*, namely, positioning plastic-sleeve label 108*a* on container 30*a* and preventing it from slipping off container 30*a*. Because bumper band 100*a* also extends across the walls 34*a* and 38*a*, the bumper band also serves as an upward facing shoulder which complements downward facing wall shoulders 134*a* and 138*a*.

Container 30*a* may include a top strengthening boss 141*a* located on top 68*a* and extending outwardly from neck 72*a*. Strengthening boss 141*a* is optionally provided to improve the structural integrity and the top load strength of the container. In the embodiment of FIG. 8, strengthening top rib 141 includes one strengthening rib extensions 144 which extends outwardly from neck 72*a* toward corner portion 44 and along a portion of upper end portion 84*a* of handle 80*a* and provides increased structural integrity of the handle. Strengthening top rib 141 also includes supplemental ribs 142, 146 and 148 which extend outward toward corner portions 42, 46 and 48, respectively.

In operation and use, container 30*a* is used in substantially the same manner as container 30 discussed above.

In many respects the modifications of the various figures resemble those of preceding modifications and the same reference numerals followed by subscript "a" designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A container comprising:

a plurality of side walls;

a plurality of corner portions interconnecting adjacent side walls;

a top having a neck, said top joined to a top portion of said side walls;

a handle fanned in a region adjacent said top and extending between two adjacent side walls within the profile of said container from a first of said corner portion;

a bumper extending around the periphery of said container across each of said side wall said bumper projecting outward from each of said side walls a distance; and a substantially planar label surface located on one of said side walls proximal said bumper and extending upwardly higher than a lower end portion of said handle, wherein said distance is sufficient to prevent contact of said label surface against a flat surface abutting against said container.

2. A container according to claim 1 wherein said bumper is continuous.

3. A container according to claim 1 wherein said bumper is offset downwardly to extend around said label surface thereby enlarging said label surface.

4. A container according to claim 1 wherein said handle forms an aperture for receiving the fingers of a user, said label surface extending upwardly above the lower end of said aperture.

5. A container according to claim 1 wherein said container further comprises a second label surface on another side wall, said second label surface proximal said bumper and extending upwardly higher than a lower end portion said handle.

6. A container according to claim 1 further each said corner portion including a downward facing shoulder located intermediate said bumper and said top, said shoulder defining a recessed portion of said corner portion extending between said bumper and said shoulder, wherein said recessed portion is adapted for receiving a flexible-sleeve label.

7. A container according to claim 6 wherein at least one said corner portion includes a corner rib for added structural integrity.

8. A container according to claim 1 further comprising a strengthening rib located on said top adjacent said neck, said strengthening rib including a rib extension extending outwardly from said neck.

9. A container comprising:

a plurality of side walls;

a plurality of corner portions interconnecting adjacent side walls;

a top having a neck, said top joined to a top portion of said side walls;

a handle formed in a region adjacent said top and extending within the profile of said container from a first of said corner portions;

an upward facing shoulder located on a first of said side walls immediately adjacent a second of said corner portions opposite said first corner portion;

a downward facing shoulder located on said first side wall intermediate said upward facing shoulder and said top, said shoulders defining a recessed portion of said first side wall extending therebetween, wherein said recessed portion is adapted for receiving a flexible-sleeve label; and a substantially planar label surface located on a second of said side walls immediately adjacent said second corner portion, said planar label surface extending proximal said upward facing shoulder and upwardly higher than said downward facing shoulder.

10. A container according to claim 9 further comprising a bumper extending around the periphery of said container and across each of said four upstanding side walls, said bumper projecting outward from each of said side walls a distance, said distance being sufficient to prevent contact of said planar label surface against a flat surface abutting against said container, said bumper forming said upward facing shoulder.

11. A container according to claim 10 wherein said bumper is continuous.

12. A container according to claim 11 wherein said bumper is offset downwardly to extend around said planar label surface thereby enlarging said planar label surface.

13. A container according to claim 12 wherein said handle forms an aperture for receiving the fingers of a user, said planar label surface extending upwardly above the lower end of said aperture.

14. A container according to claim 13 wherein said container further comprises a second label surface on another side wall, said second label surface proximal said, bumper and extending upwardly higher than a lower end portion of said handle.

15. A container according to claim 14 wherein at least one said corner portion includes a corner rib for added structural integrity.

16. A container according to claim 15 further comprising a strengthening rib located on said top adjacent said neck, said strengthening rib including a rib extension extending outwardly from said neck.

17. A container comprising:

a plurality of side walls;

a plurality of corner portions interconnecting adjacent side walls;

a top having a neck, said top joined to a top portion of said side walls;

a handle formed generally in a region adjacent said top and extending between two adjacent side walls within the profile of said container; and a strengthening boss located upwardly from said to and encircling said neck, said strengthening boss including a rib extension extending outwardly from said neck along a top portion of said handly.

18. A container according to claim 17 comprising a plurality of supplemental ribs extending outwardly from said neck, each supplemental rib extending outwardly toward a respective one of said corner portions.

19. A container according to claim 18 farther comprising:

an upward facing shoulder located on at least one of said corner portions;

a downward facing shoulder located on said a least one said corner portion intermediate said upward facing shoulder and said top, said shoulders defining a recessed portion of said corner portion extending therebetween, wherein said recessed portion is adapted for receiving flexible-sleeve label; and a substantially planar label surface located on one of said side walls proximal said upward facing shoulder and extending upwardly higher than said downward facing shoulder.

20. A container according to claim 19 further comprising a bumper extending around the periphery of said container and across each of said four upstanding side walls, said bumper projecting outward from each of said side walls a distance, said distance being sufficient to prevent contact of said planar label surface against a flat surface abutting against said container, said bumper forming said upward facing shoulder.

21. A container comprising:

a plurality of side walls;

a plurality off corner potions interconnecting adjacent side walls;

a top having a neck, said top joined to a top portion of said side walls;

a handle formed in a region adjacent said top and extending within the profile of said container from a first of said corner portions;

an upward facing shoulder located on a first of said side walls immediately adjacent said first corner portion;

a downward facing shoulder located on said first side wall intermediate said upward facing shoulder and said top, said shoulders defining a recessed portion of said first side wall extending therebetween, wherein said recessed portion is adapted for receiving a flexible-sleeve label; and a substantially planar label surface located on a second of said side walls immediately adjacent said first corner portion, said planar label surface extending proximal said upward facing shoulder and upwardly higher than said downward facing shoulder.

22. A container according to claim 21 further comprising a bumper extending around the periphery of said container and across each of said four side walls, said bumper projecting outward from each of said side walls a distance, said distance being sufficient to prevent contact of said planar label surface against a flat surface abutting against said container said bumper forming said upward facing shoulder.

23. A container according to claim 22 wherein said bumper is continuous.

24. A container according to claim 23 wherein said bumper is offset downwardly to extend around said planar label surface thereby enlarging said planar label surface.

25. A container according to claim 24 wherein said handle forms an aperture for receiving the fingers of a user, said planar label surface extending upwardly above the low end of said aperture.

26. A container according to claim 25 wherein said container further comprises a second label surface on another side wall, said second label surface proximal said bumper and extending upwardly higher than a lower end portion of said handle.

27. A container according to claim 25 wherein at least one said corner portion includes a corner rib for added structural integrity.

28. A container according to claim 27 further comprising a strengthening rib located on said top adjacent said neck, said strengthening rib including a rib extension extending outwardly from said neck.

* * * * *

UNITED STATES PATENT AND TRADEMARK OFFICE

CERTIFICATE OF CORRECTION

PATENT NO. : 6,889,858 B2
DATED : May 10, 2005
INVENTOR(S) : Matthew S. McCollum et al.

It is certified that error appears in the above-identified patent and that said Letters Patent is hereby corrected as shown below:

Column 12,
Line 55, change "a handle fanned" to -- a handle formed --.
Line 57, change "said corner portion" to -- said corner portions --.

Column 13,
Line 16, delete "further".

Signed and Sealed this

Twelfth Day of July, 2005

JON W. DUDAS
*Director of the United States Patent and Trademark Office*